US010160103B2

(12) United States Patent
Su

(10) Patent No.: US 10,160,103 B2
(45) Date of Patent: Dec. 25, 2018

(54) TOOL WITH PIVOTING FUNCTION

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 222 days.

(21) Appl. No.: 15/353,824

(22) Filed: Nov. 17, 2016

(65) Prior Publication Data

US 2018/0071898 A1 Mar. 15, 2018

(30) Foreign Application Priority Data

Sep. 13, 2016 (TW) ..... 105129808 A

(51) Int. Cl.
*B25B 23/00* (2006.01)
*B25B 15/00* (2006.01)

(52) U.S. Cl.
CPC ..... *B25B 23/0028* (2013.01); *B25B 23/0021* (2013.01)

(58) Field of Classification Search
CPC ..... B25B 23/0021; B25B 23/0028; B25B 15/008
See application file for complete search history.

(56) References Cited

U.S. PATENT DOCUMENTS 8,695,463 B2 4/2014 Su

*Primary Examiner* — David B Thomas
(74) *Attorney, Agent, or Firm* — Alan D. Kamrath; Kamrath IP Lawfirm, P.A.

(57) ABSTRACT

A first pivoting member has a first connecting end including at least one first jaw portion and at least one second jaw portion disposed in a spaced relationship from the at least one first jaw portion with a gap defined therebetween. A second pivoting member is pivotally connected to the first pivoting member and is pivotal about a pivotal connection. The second pivoting member has a second connecting end pivotally connected with the first connecting end. The second connecting end includes a joining portion pivotally disposed in the gap. At least one strengthening member connects with and spans between the at least one first and at least one second jaw portions and restrains the joining portion from moving out of an opening between the at least one first and at least one second jaw portions.

18 Claims, 14 Drawing Sheets

TOOL WITH PIVOTING FUNCTION

BACKGROUND OF THE INVENTION

1. Field of the Invention

The present invention relates to a tool and, more particularly, to a tool with a pivoting function.

2. Description of the Related Art

TW Pat. No. I429520 discloses a pivoting assembly for a tool including first and second pivoting members pivotally connected with each other, and a positioning device. The first pivoting member includes first and second jaw portions extending from an end thereof. An opening is formed between the first and second jaw portions. An inner periphery surface is formed between the first and second jaw portions. An aperture is extended in the inner periphery surface. The second pivoting member includes at least one arm portion extending from an end thereof. An engaging portion is formed at an end of the arm portion. The engaging portion is engaged with the first and second jaw portions. The positioning device is received in the aperture and abutted against the engaging portion of the second pivoting member.

Unfortunately, the first and second jaws are very liable to break if the tool driving an object fails to withstand the increased loading applied thereto.

The present invention is, therefore, intended to obviate or at least alleviate the problems encountered in the prior art.

SUMMARY OF THE INVENTION

According to the present invention, a tool with a pivoting function includes a first pivoting member, a second pivoting member, and at least one strengthening member. The first pivoting member has a first connecting end including at least one first jaw portion and at least one second jaw portion disposed in a spaced relationship from the at least one first jaw portion with a gap defined therebetween. The second pivoting member is pivotally connected to the first pivoting member and is pivotal about a pivotal connection. The second pivoting member has a second connecting end pivotally connected with the first connecting end. The second connecting end includes a joining portion pivotally disposed in the gap. The at least one strengthening member connects with and spans between the at least one first and at least one second jaw portions and restrains the joining portion from moving out of an opening between the at least one first and at least one second jaw portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a tool that can drive an object at different angles.

It is another objective of the present invention that first and second pivoting members of the tool are pivotally connected with each other without a pivot joint inserting therethrough.

It is yet another objective of the present invention that the first and second pivoting members can withstand high loading and stress applied thereto during driving operations of the tool.

Other objectives, advantages, and new features of the present invention will become apparent from the following detailed description of the invention when considered in conjunction with the accompanied drawings.

BRIEF DESCRIPTION OF THE DRAWINGS

The illustrative embodiments may best be described by reference to the accompanying drawings where.

Figure 1:
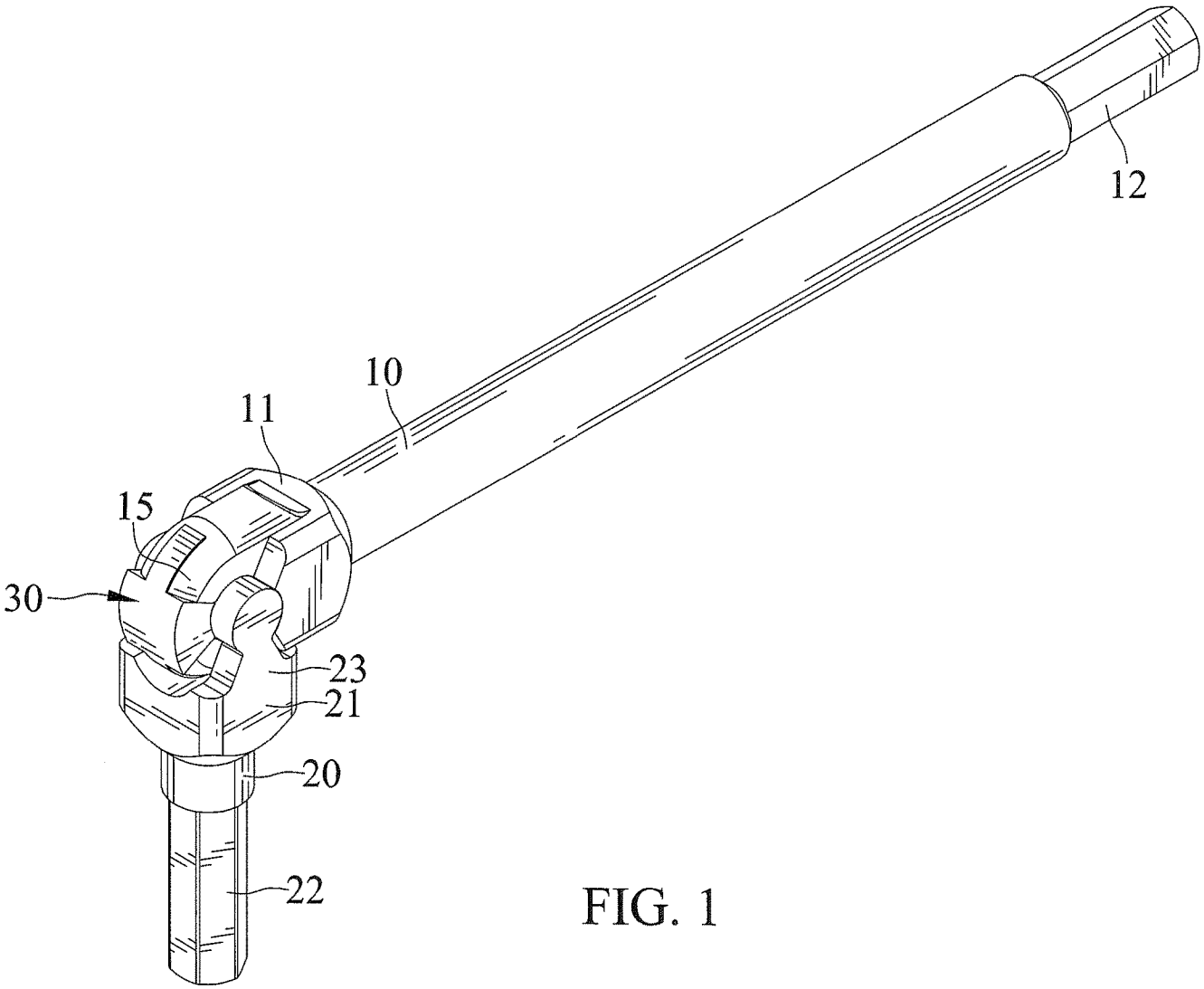
FIG. 1 shows a perspective view of a tool with a pivoting function of a first embodiment according to the present invention.
Figure 2:
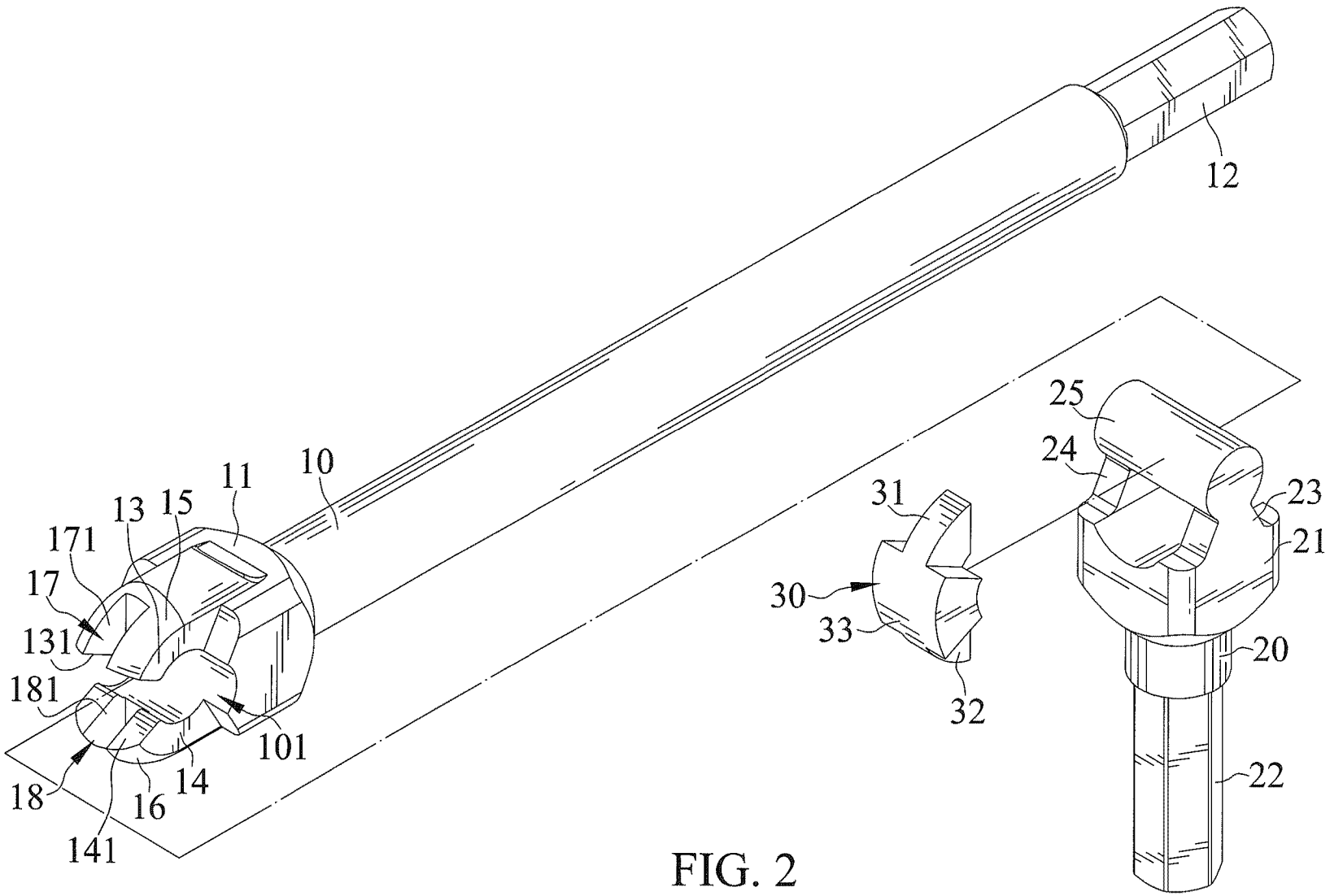
FIG. 2 shows an exploded, perspective view of the tool of FIG. 1.
Figure 3:
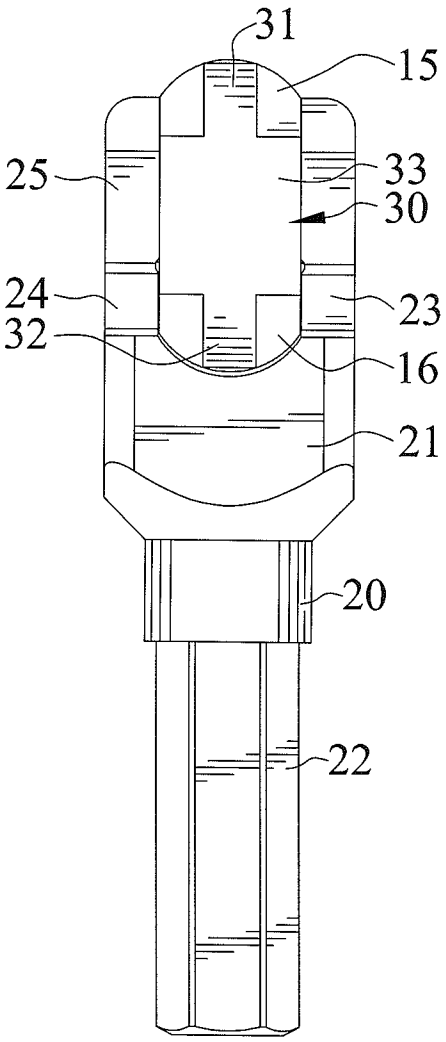
FIG. 3 shows a front view of the tool of FIG. 1.
Figure 4:
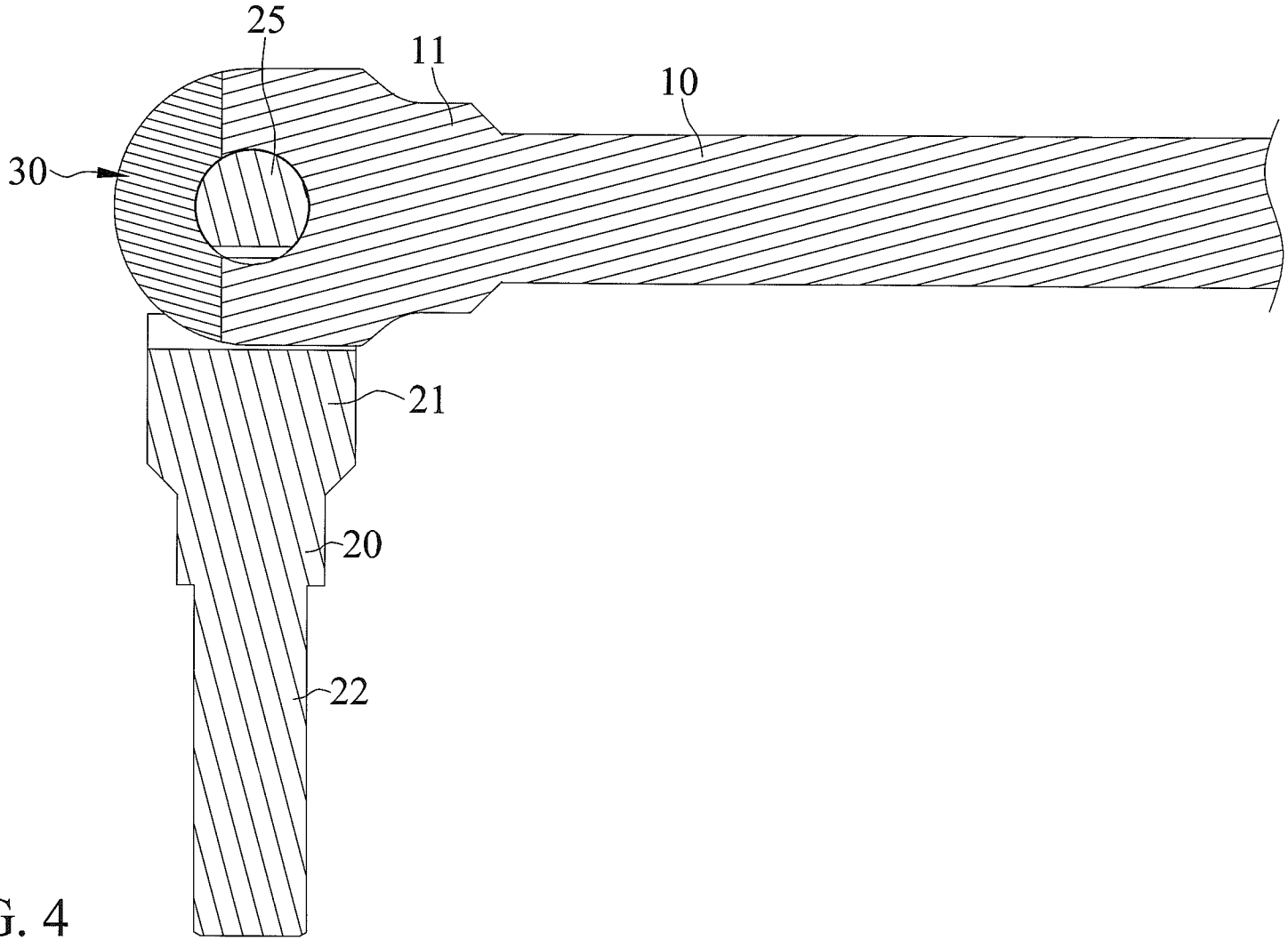
FIG. 4 shows a cross-section view of the tool of FIG. 1.
Figure 5:
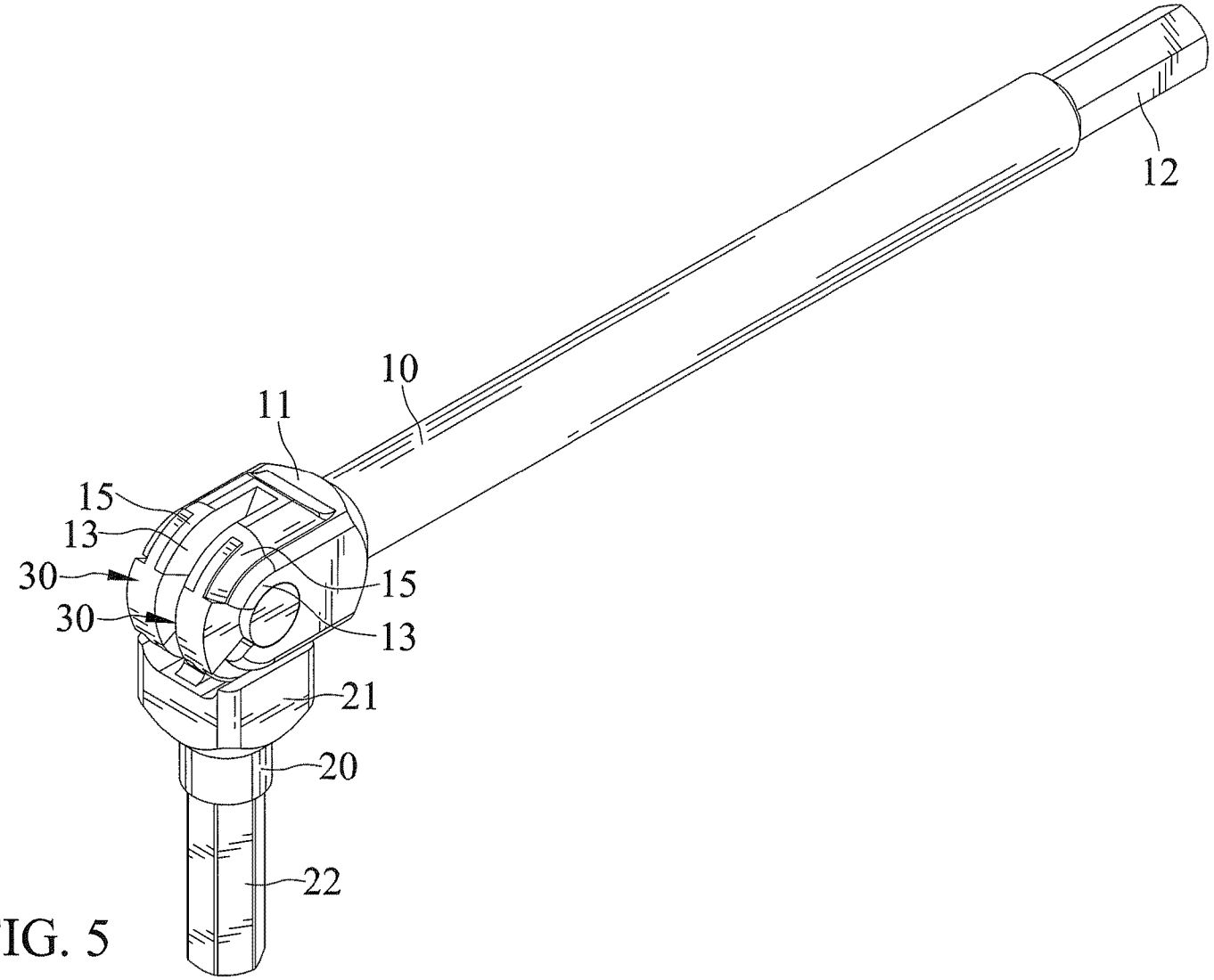
FIG. 5 shows a perspective view of a tool with a pivoting function of a second embodiment according to the present invention.
Figure 6:
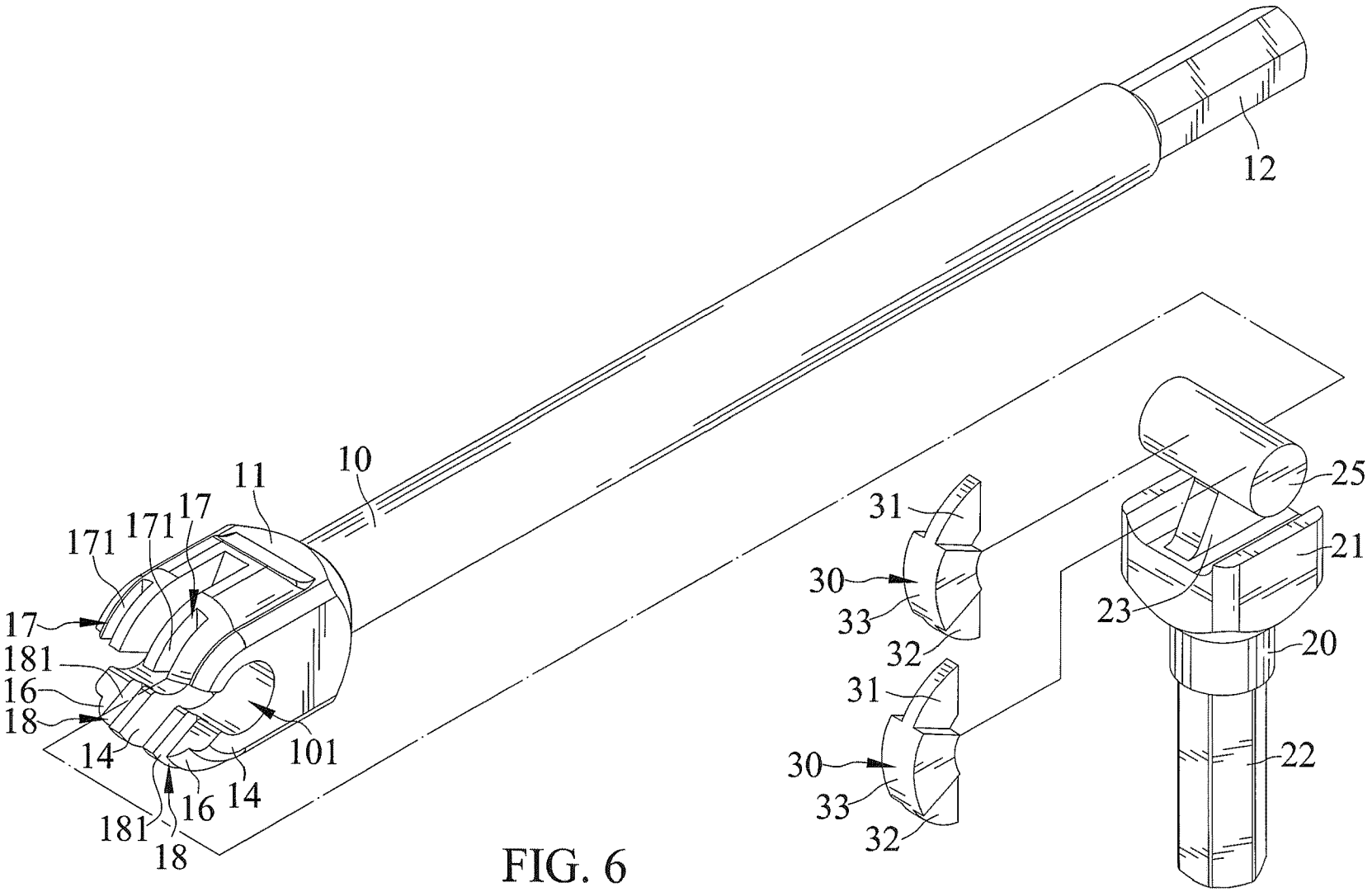
FIG. 6 shows an exploded, perspective view of the tool of FIG. 6.
Figure 7:
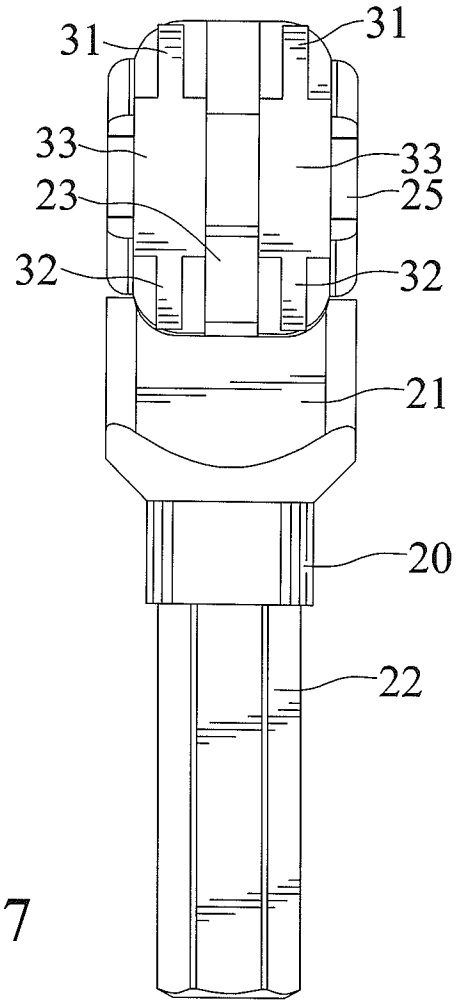
FIG. 7 shows a front view of the tool of FIG. 5.
Figure 8:
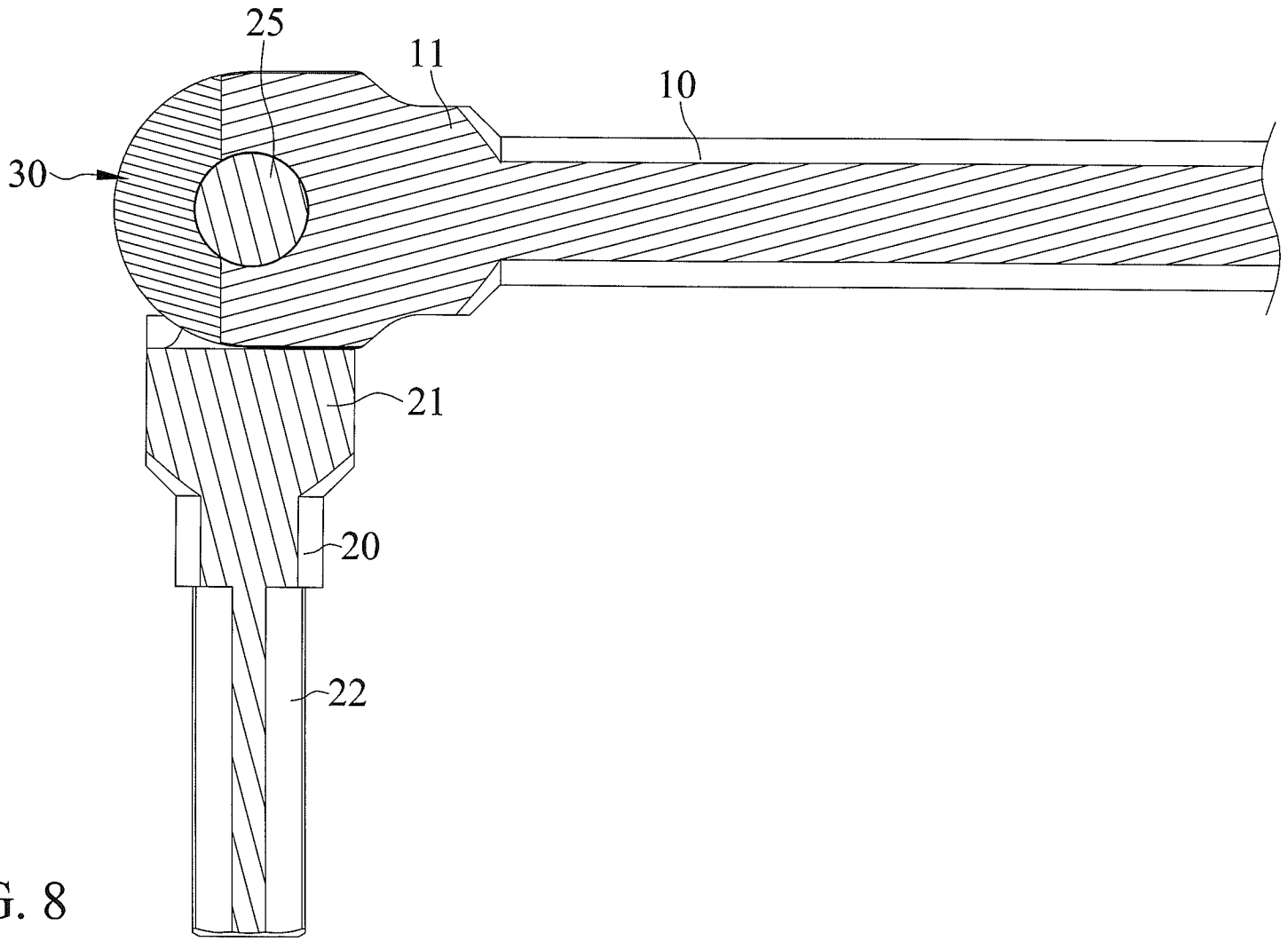
FIG. 8 shows a cross-section view of the tool of FIG. 5.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

FIGS. 1 through 4 show a first embodiment of a tool with a pivoting function according to the present invention shown in the drawings. The tool includes first and second pivoting members 10 and 20 pivotally connected with each other. The tool includes at least one strengthening member 30 reinforcing the pivotal connection between the first and second pivoting members 10 and 20. The at least one strengthening member 30 connects with the first and second pivoting members 10 and 20.

The first pivoting member 10 has a first end and a second end and extends longitudinally from the first end to the second end. The first and second ends of the first pivoting member 10 oppose to each other. The first pivoting member 10 includes the first end thereof including a first connecting end 11 and the second end thereof including a first driving end 12 respectively. The first driving end 12 of the first pivoting member 10 is adapted to engage with an object to be driven by the tool or to be gripped as a handle by a user. The first driving end 12 defines an engaging bar. The first driving end 12 is polygonal in cross section. The second pivoting member 20 has a first end and a second end and extends longitudinally from the first end to the second end. The first and second ends of the second pivoting member 20 oppose to each other. The second pivoting member 20 includes the first end thereof including a second connecting end 21 and the second end thereof including a second driving end 22 respectively. The first and second pivoting members 10 and 20 are pivotally connected with each other with the second connecting end 21 pivotally connected with the first connecting end 11. The second driving end 22 of the second pivoting member 20 is adapted to engage with an object to be driven by the tool or to be gripped as a handle by a user. The second driving end 22 defines an engaging bar. The second driving end 22 is polygonal in cross section.

The first connecting end 11 includes at least one first jaw portion 13, at least one second jaw portion 14, a first reinforcement portion 15, a second reinforcement portion 16, at least one first connecting portion 17, and at least one second connecting portion 18. The at least one first and at least one second jaw portions 13 and 14 extend in a direction away from the first driving end 12. The at least one first and the least one second jaw portions 13 and 14 face oppositely and are disposed in a spaced relationship with a gap 101 defined therebetween. The gap 101 defines an opening between free ends of the at least one first and at least one second jaw portions 13 and 14. The gap 101 also defines two opposite open ends laterally. The first reinforcement portion 15 connects with the at least one first jaw portion 13 and thus reinforces the at least one first jaw portion 13. The second reinforcement portion 16 connects with the at least one second jaw portion 14 and thus reinforces the at least one second jaw portion 14. The at least one first connecting portion 17 is located with the at least one first jaw portion 13. The at least one first connecting portion 17 is located with the first reinforcement portion 15. The at least one second connecting portion 18 is located with the at least one second jaw portion 14. The at least one second connecting portion 18 is located with the second reinforcement portion 16.

The at least one first jaw portion 13 includes a first surface 131. The first surface 131 is located on the free end of the at least one first jaw portion 13. The at least one second jaw portion 14 includes a second surface 141. The second surface 141 is located on the free end of the at least one second jaw portion 14. The first and second surfaces 131 and 141 are located adjacent to the opening of the gap 101. The at least one first jaw portion 13 and the first reinforcement portion 15 are integrated and have a first thickness greater than a thickness of the at least one first jaw portion 13, thereby reinforcing the structure of the at least one first jaw portion 13 and prolonging the life of the tool. The at least one second jaw portion 14 and the second reinforcement portion 16 are integrated and have a second thickness greater than a thickness of the at least one second jaw portion 14, thereby reinforcing the structure of the at least one second jaw portion 14 and prolonging the life of the tool.

The at least one first jaw portion 13 includes a first recess 171. The first recess 171 defines the at least one first connecting portion 17. The first recess 171 is located adjacent to an end of the at least one first jaw portion 13 which is distal to the first connecting end 11. The first recess 171 extends to and defines a hole on the free end of the at least one first jaw portions 13. Likewise, the first recess 171 defines the hole on the first surface 131. The at least one second jaw portion 14 includes a second recess 181. The second recess 181 defines the at least one second connecting portion 18. The second recess 181 is located at ends of the at least one second jaw portion 14 which is distal to the first connecting end 11. The second recess 181 extends to and defines a hole on the free end of the at least one second jaw portion 14. Likewise, the second recess 181 defines the hole on the second surface 141.

The second connecting end 21 includes at least one extension portion and a joining portion 25. The at least one extension portion extends in a direction away from the second driving end 22. The joining portion 25 connects with the at least one extension portion. The at least one extension portion includes a first extension portion 23 and a second extension portion 24. The first extension portion 23 and the second extension portion 24 face oppositely and are disposed in a spaced relationship with a space defined therebetween. The joining portion 25 extends from the first extension portion 23 to the second extension portion 24 and delimits a side of the space. The space is delimited by an end of the second pivoting member 20 from which the first and second extension portions 23 and 24 extend, the first and second extension portions 23 and 24, and the joining portion 25. The first and second pivoting members 10 and 20 are pivotally connected with each other with the joining portion 25 pivotally disposed in the gap 101 and between the at least one first and at the least one second jaw portions 13 and 14. The joining portion 25 is circular in cross section.

When the first and second pivoting members 10 and 20 pivot with respect to each other, the first pivoting member 10 pivots with respect to the second pivoting member 20 about a pivot axis, and the space between the first and second extension portions 23 and 24 can selectively receive the at least one first jaw portion 13 and the at least one second jaw portion 14. The joining portion 25 extends longitudinally along the pivot axis between the first and second extension portions 23 and 24.

The at least one strengthening member 30 includes a first mounting portion 31, a second mounting portion 32, and a restraining portion 33. The restraining portion 33 extends from the first mounting portion 31 to the second mounting portion 32. The at least one strengthening member 30 has a curved contour. The curved contour extends from the first mounting portion 31, then the restraining portion, to the second mounting portion 32. The at least one strengthening member 30 connects with the first and second pivoting members 10 and 20 with the first and second mounting portions 31 and 32 respectively mounted on the at least one first and at least one second connecting portions 17 and 18. Furthermore, the first mounting portion 31 is mounted in the first recess 171 and the second mounting portion 32 is mounted in the second recess 181 respectively. When the at least one strengthening member 30 is integrated with the first and second pivoting members 10 and 20, the restraining portion 33 extends between the at least one first and at least one second jaw portions 13 and 14 and restrains the joining portion 25 from moving out of the opening of the gap 101. The restraining portion 33 abuts the joining portion 25 when restraining it. The restraining portion 33 abuts the outer periphery of the joining portion 25 when restraining it. In addition, the restraining portion 33 includes first and second end surfaces respectively abutting the first and second surfaces 131 and 141 which can secure and reinforce its connection with the first and second pivoting members 10 and 20. The first and second end surfaces respectively include the first and second mounting portions 31 and 32 protruding therefrom.

Each of the at least one first and at least one second jaw portions 13 and 14 and the restraining portion 33 includes a curved side delimiting the gap 101. The curved sides of the at least one first and at least one second jaw portions 13 and 14 and the restraining portion 33 cooperate to form an edge extending annularly.

FIGS. 5 through 8 show a second embodiment of a tool with a pivoting function according to the present invention shown in the drawings. The second embodiment is similar to the first embodiment except that the at least one first jaw portion 13 includes two first jaw portions 13 and the at least one second jaw portion 14 includes two second jaw portions 14, the at least one strengthening member 30 includes two strengthening members 30, the at least one extension portion includes one extension portion 23, and two spaces are delimited. The one extension portion 23 is disposed between the two spaces. One of the two spaces is delimited by a lateral side of the one extension portion 23 and the joining portion 25. Another of the two spaces is delimited by another lateral side of the one extension portion 23, and the joining portion 25. As set forth, one of the two spaces can selectively receive one of the two first jaw portions 13 and one of the two second jaw portions 14, and another of the two spaces can selectively receive another of the two first jaw portions 13 and another of the two second jaw portions 14.

Figure 9:
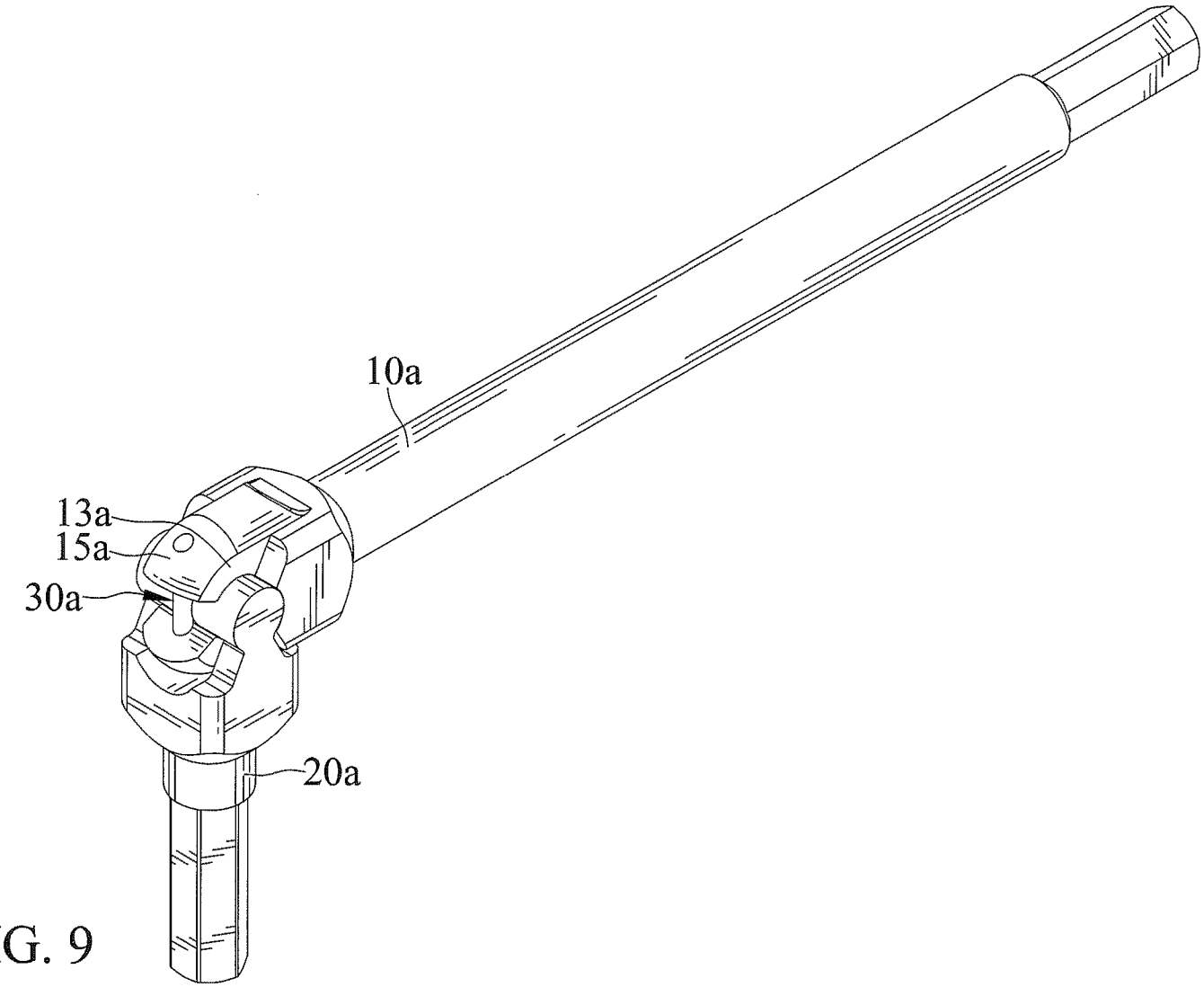
FIG. 9 shows a perspective view of a tool with a pivoting function of a third embodiment according to the present invention.
Figure 10:
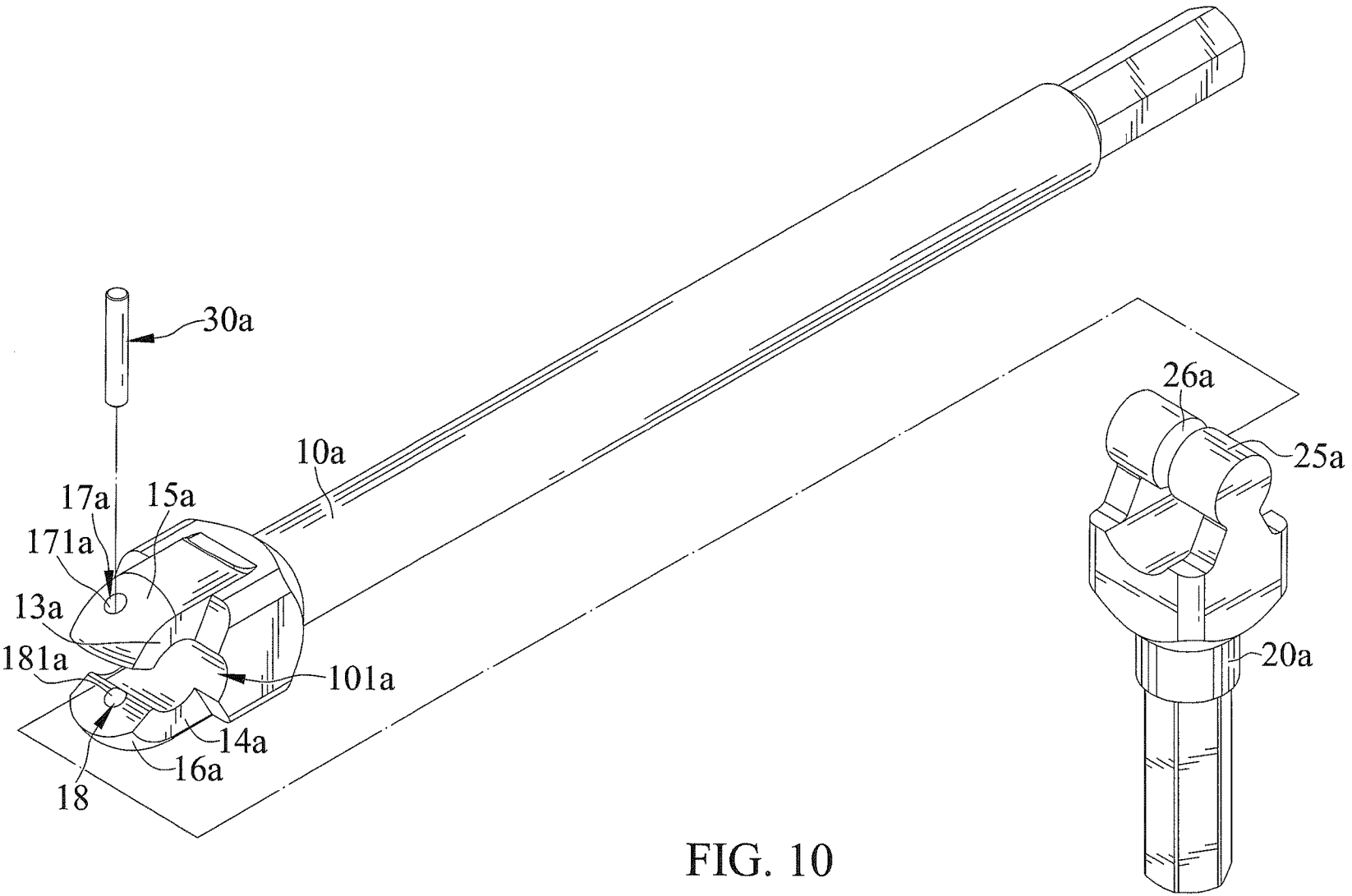
FIG. 10 shows an exploded, perspective view of the tool of FIG. 9.
Figure 11:
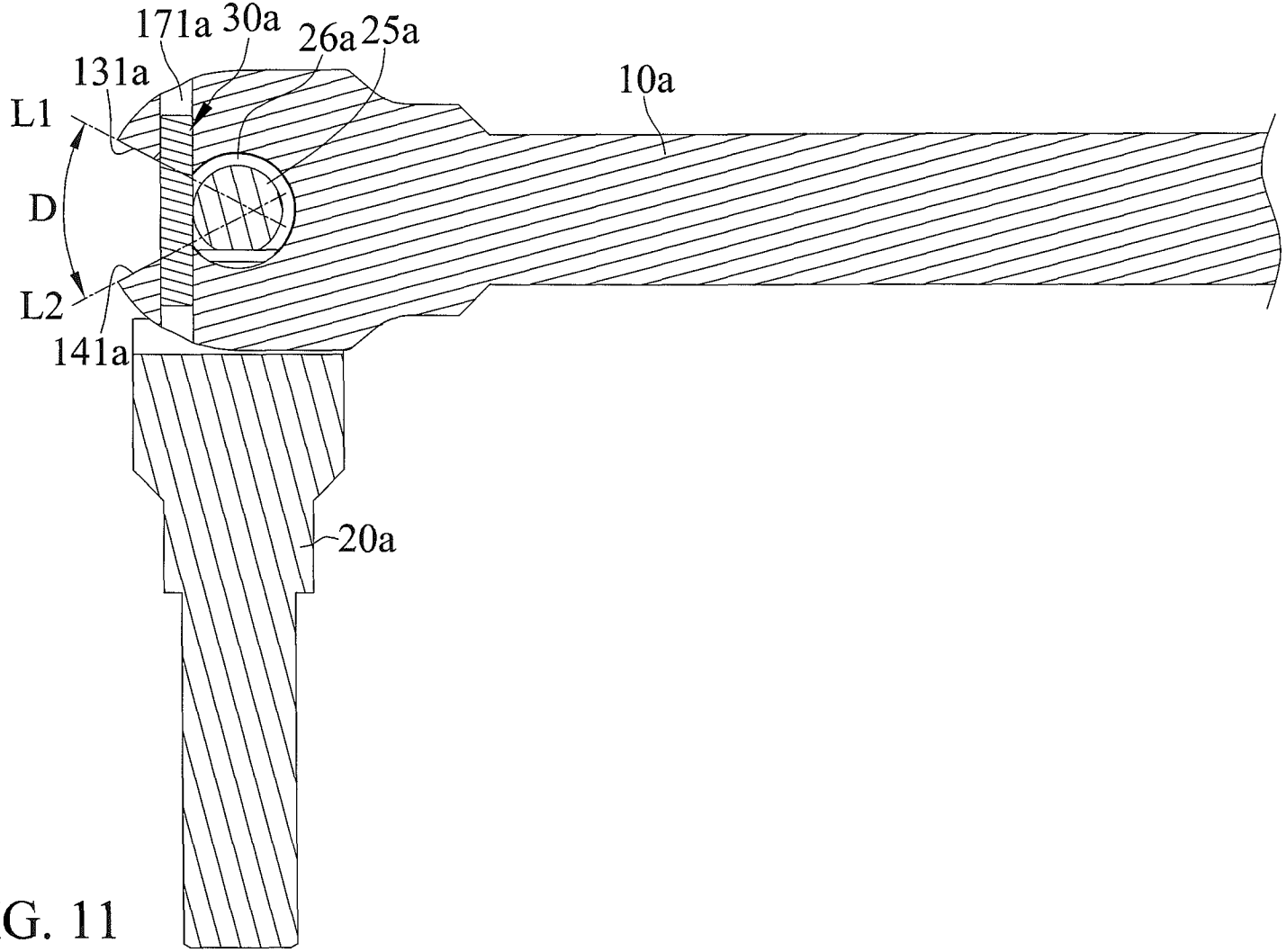
FIG. 11 shows a cross-section view of the tool of FIG. 9.

FIGS. 9 through 11 show a third embodiment of the tool with a pivoting function according to the present invention shown in the drawings, with like numerals utilized to denote similar elements of the first embodiment, however, bearing a suffix "a". In the third embodiment, a first pivoting member 10*a* includes at least one first jaw portion 13*a*, a first reinforcement portion 15*a* connecting with and reinforcing the at least one first jaw portion 13*a*, at least one second jaw portion 14*a*, a second reinforcement portion 16*a* connecting with and reinforcing the at least one second jaw portion 14*a*, at least one first connecting portion 17*a* located with the at least one first jaw portion 13*a* and the first reinforcement portion it 15*a*, at least one second connecting portion 18*a* located with the at least one second jaw portion 14*a* and the second reinforcement portion 16*a*, a first recess 171*a* extending through the at least one first jaw portion 13*a* in an opposing direction of the at least one first and at least one second jaw portions 13*a* and 14*a* and defining the at least one first connecting portion 17*a*, a second recess 181*a* extending through the at least one second jaw portion 14*a* in the opposing direction of the at least one first and at least one second jaw portions 13*a* and 14*a* and defining the at least one second connecting portion 18*a*. However, the first pivoting member 10*a* differentiates from the first pivoting member 10 of the first embodiment in that the first and second recesses 171*a* and 181*a* have closed peripheries. The first recess 171*a* does not extend to and defines a hole on the free end of the at least one first jaw portion 13*a*. The second recess 181*a* does not extend to and defines a hole on the free end of the at least one second jaw portion 14*a*. In addition, a first surface 131*a* located on the free end of the at least one first jaw portion 13*a* lies along a first axis L1 and a second surface 141*a* lies along a second axis L2, and the first and second surfaces 131*a* and 141*a* extend divergently from each other away from a gap 101*a* between the at least one first and at least one second jaw portions 13*a* and 14*a*. The first and second axes L1 and L2 are crossed and angled at an angle D.

Furthermore, a second pivoting member 20*a* differentiates from the second pivoting member 20 of the first embodiment in that a groove 26*a* is recessed into the outer periphery of a joining portion 25*a* and is configured for engaging with a strengthening member 30*a*. Like the joining portion 25 of the first embodiment, the joining portion 25*a* is circular in cross section.

The strengthening member 30*a* abuts the joining portion 25 when restraining it and has a first end mounted in the first recess 171*a* and a second end mounted in the second recess 181*a*. The strengthening member 30 is in a form of a rod.

Figure 12:
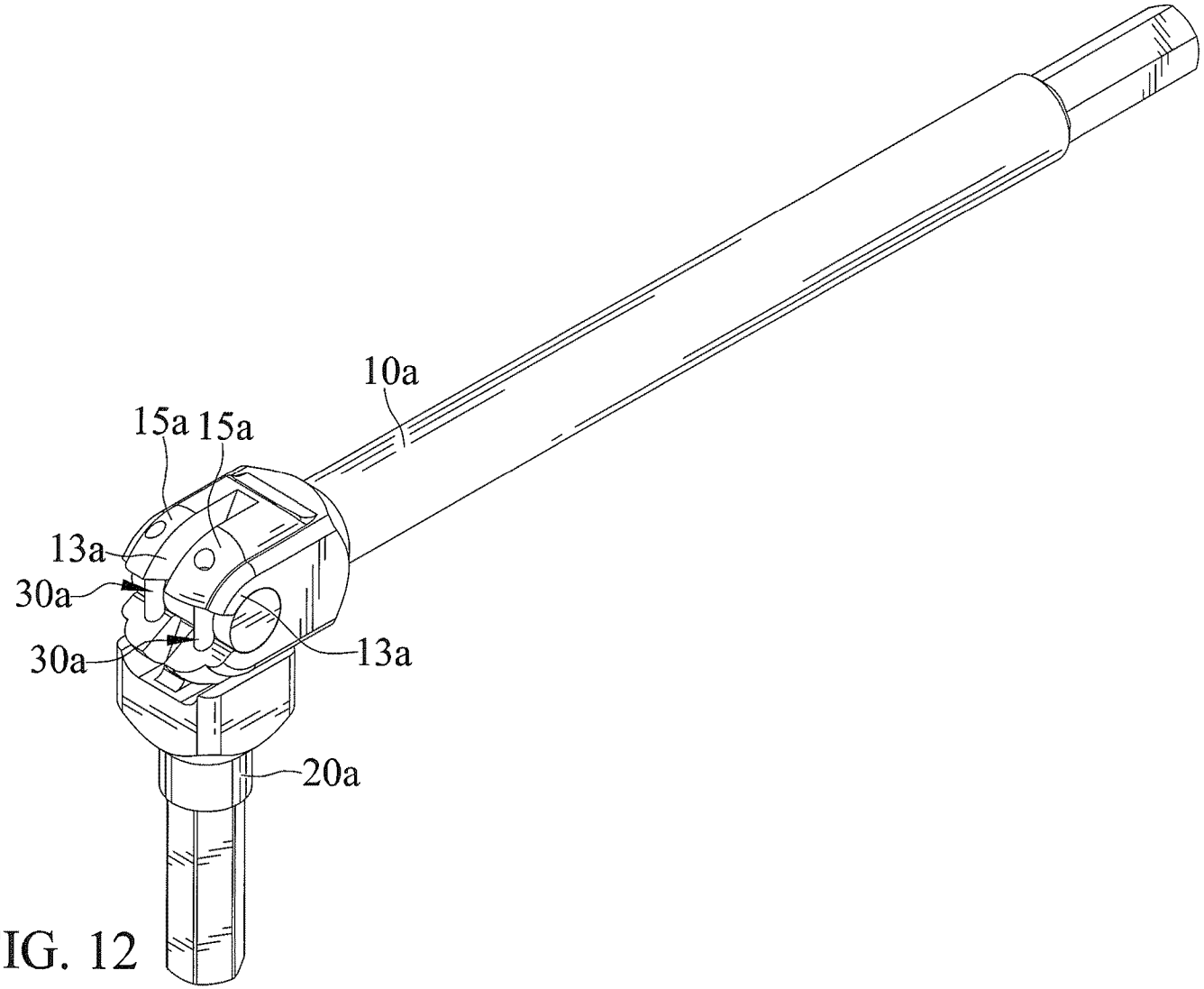
FIG. 12 shows a perspective view of a tool with a pivoting function of a fourth embodiment according to the present invention.
Figure 13:
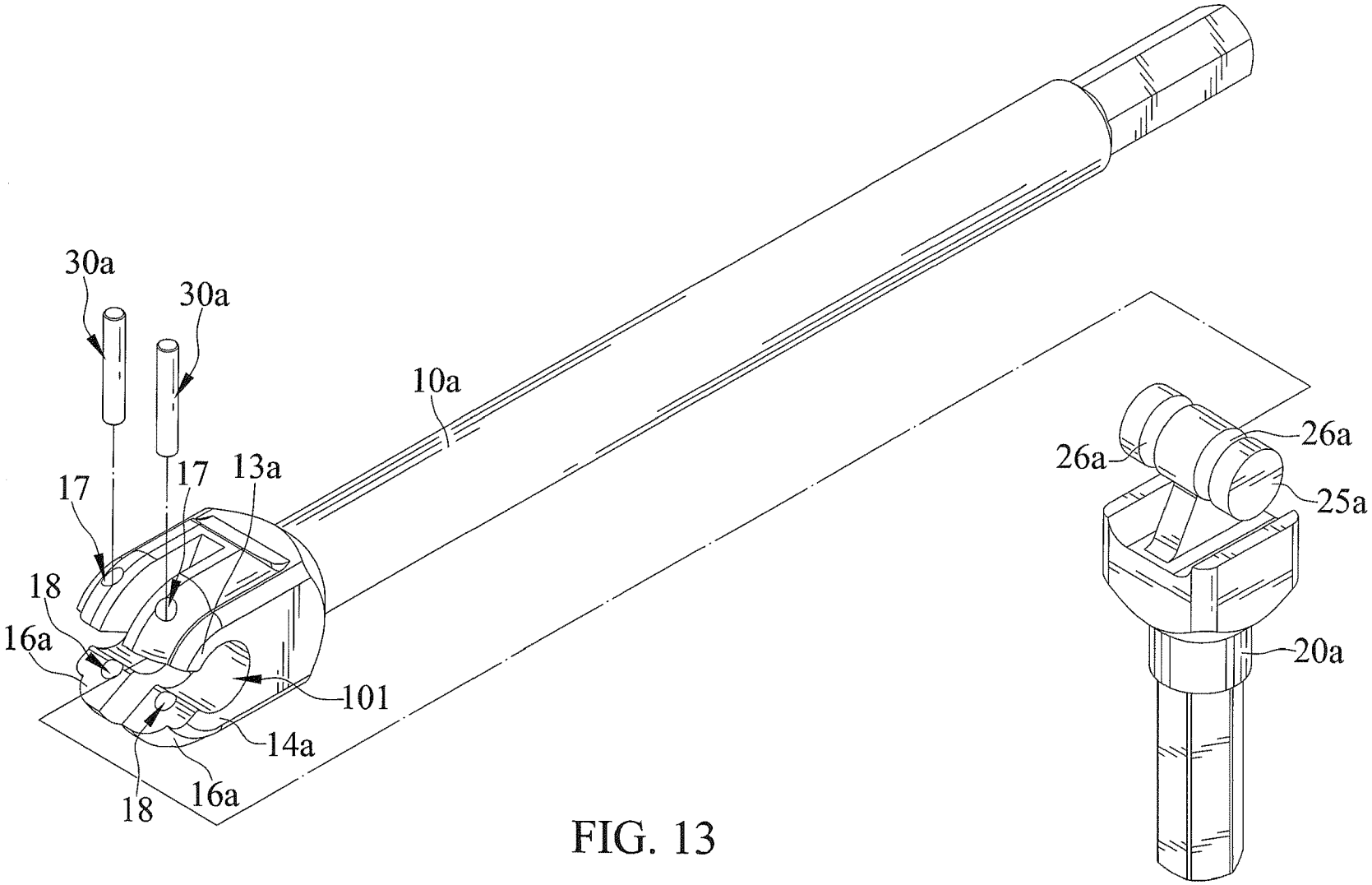
FIG. 13 shows an exploded, perspective view of the tool of FIG. 12.
Figure 14:
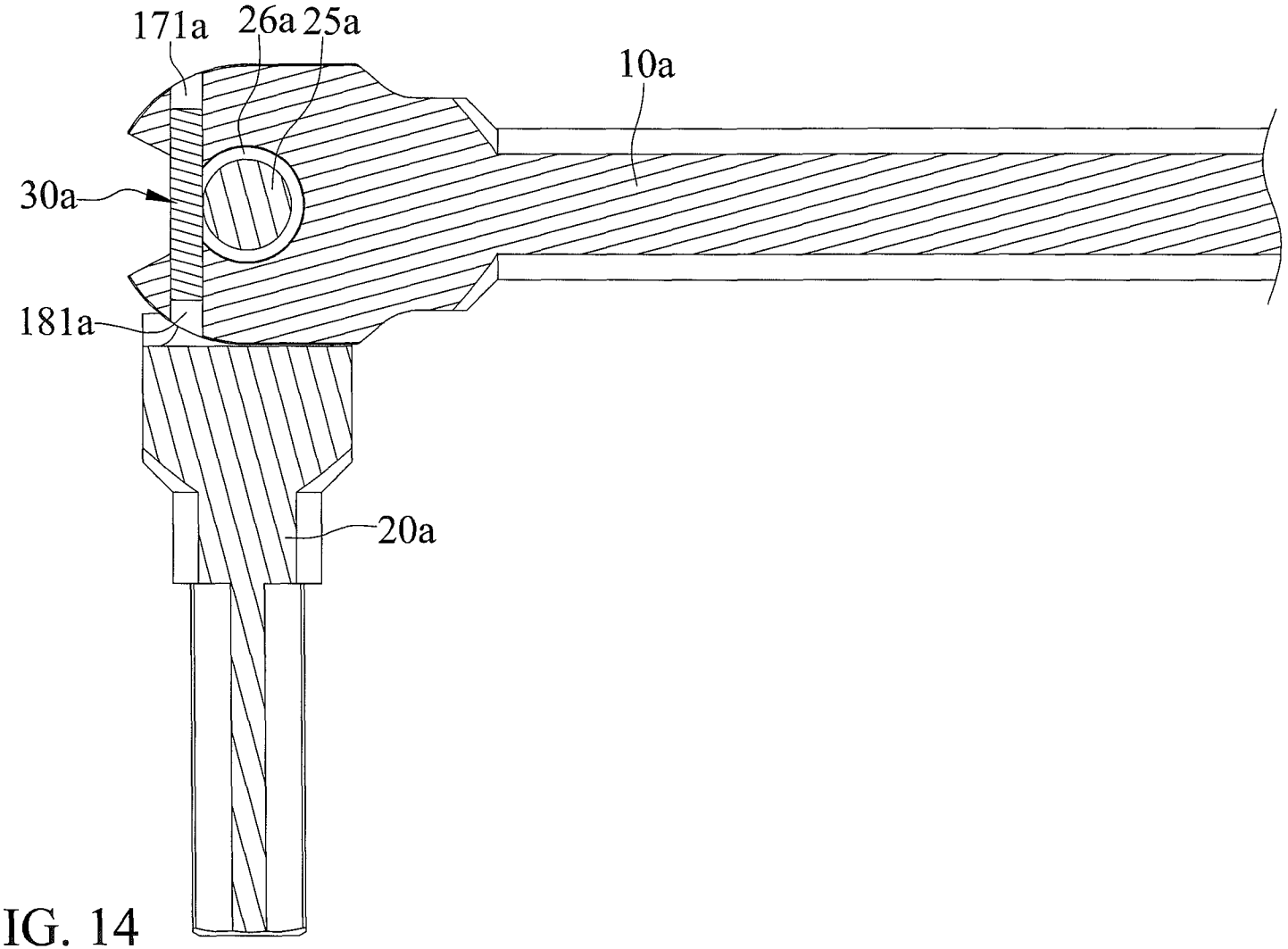
FIG. 14 shows a cross-sectional view of the tool of FIG. 12.

FIGS. 12 through 14 show a fourth embodiment of a tool with a pivoting function according to the present invention shown in the drawings. The fourth embodiment is similar to the third embodiment except that the at least one first jaw portion 13*a* includes two first jaw portions 13*a* and the at least one second jaw portion 14*a* includes two second jaw portions 14*a*, the at least one strengthening member 30*a* includes two strengthening members 30*a*, the at least one extension portion includes one extension portion, and two spaces are delimited. The one extension portion is disposed between the two spaces. As set forth, one of the two spaces can selectively receive one of the two first jaw portions 13*a* and one of the two second jaw portions 14, and another of the two spaces can selectively receive another of the two first jaw portions 13*a* and another of the two second jaw portions 14*a*.

In view of the foregoing, the first and second pivoting members 10, 10*a*, 20, and 20*a* are pivotally connected with each other and the at least one strengthening member 30 and 30*a* reinforces the pivotal connection between the first and second pivoting members 10, 10*a*, 20, and 20*a*.

The first pivoting member 10 and 10*a* includes the gap 101 and 101*a* pivotally receiving the joining portion 25 and 25*a* of the second pivoting member 20 and 20*a*.

The at least one strengthening member 30 and 30*a* spans between the at least one first and at least one second jaw portions 13, 13*a*, 14, and 14*a* and the gap 101*a* and restrains the joining portion 25 and 25*a*. The at least one strengthening member 30 and 30*a* also spans the opening of the gap 101 and 101*a*.

The first reinforcement portion 15 connects with the at least one first jaw portion 13 and thus reinforces the at least one first jaw portion 13. The second reinforcement portion 16 connects with the at least one second jaw portion 14 and thus reinforces the at least one second jaw portion 14. The at least one first jaw portion 13 and the first reinforcement portion 15 are integrated and have a first thickness greater than a thickness of the at least one first jaw portion 13, thereby reinforcing the structure of the at least one first jaw portion 13 and prolonging the life of the tool. The at least one second jaw portion 14 and the second reinforcement portion 16 are integrated and have a second thickness greater than a thickness of the at least one second jaw portion 14, thereby reinforcing the structure of the at least one second jaw portion 14 and prolonging the life of the tool.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A tool with a pivoting function comprising:

a first pivoting member having a first connecting end including at least one first jaw portion and at least one second jaw portion disposed in a spaced relationship from the at least one first jaw portion with a gap defined therebetween;

a second pivoting member pivotally connected to the first pivoting member and being pivotal about a pivotal connection, with the second pivoting member having a second connecting end pivotally connected with the first connecting end, with the second connecting end including a joining portion pivotally disposed in the gap; and at least one strengthening member connecting with and spanning between the at least one first and at least one second jaw portions and restraining the joining portion from moving out of an opening between the at least one first and at least one second jaw portions.

2. The tool as claimed in claim 1, wherein the at least one first and at least one second jaw portions respectively connect with first and second reinforcement portions, wherein the first and second reinforcement portions are configured to respectively reinforce the at least one first jaw portion, wherein the at least one first jaw portion and the first reinforcement portion are integrated and have a thickness greater than a thickness of the at least one first jaw portion, wherein the at least one second jaw portion and the second reinforcement portion are integrated and have a second thickness greater than a thickness of the at least one second jaw portion.

3. The tool as claimed in claim 1, wherein the second connecting end includes at least one extension portion connecting with the joining portion, wherein an end of the second pivoting member, the at least one extension portion, and the joining portion delimit at least one space, and wherein the at least one space selectively receive the at least one first jaw portion and the at least one second jaw portion.

4. The tool as claimed in claim 3, wherein the at least one extension portion includes a first extension portion and a second extension portion facing oppositely disposed in a spaced relationship with the space defined therebetween, and wherein the joining portion extends from the first extension portion to the second extension portion and delimits a side of the space.

5. The tool as claimed in claim 4, wherein the at least one first jaw portion includes two first jaw portions and the at least one second jaw portion includes two second jaw portions, wherein the at least one space includes two spaces, wherein the at least one extension portion includes one extension portion which includes a lateral side delimiting one of two spaces and another lateral side delimiting another of the two spaces respectively, and wherein the one extension portion is disposed between the two spaces.

6. The tool as claimed in claim 1, wherein the first connecting end includes at least one first and at least one second connecting portions respectively located with the at least one first and at least one second jaw portions, and wherein the at least one first and at least one second connecting portions connect with the strengthening member.

7. The tool as claimed in claim 6, wherein the at least one first and at least one second connecting portions respectively define first and second recesses.

8. The tool as claimed in claim 7, wherein the gap defines an opening between free ends of the at least one first and at least one second jaw portions, wherein the first recess extends to and defines a hole on the free end of the at least one first jaw portions.

9. The tool as claimed in claim 8, wherein the second recess extends to and defines a hole on the free end of the at least one second jaw portion.

10. The tool as claimed in claim 9, wherein the at least one strengthening member includes a first mounting portion, a second mounting portion, and a restraining portion, wherein the first and second mounting portions are respectively mounted in the first and second recesses, wherein the restraining portion abuts the joining portion and includes first and second end surfaces respectively abutting first and second surfaces on the free ends of the at least one first and at least one second jaw portions.

11. The tool as claimed in claim 7, wherein the gap defines an opening between free ends of the at least one first and at least one second jaw portions, wherein the first recess extends through the at least one first jaw portion in an opposing direction of the at least one first and at least one second jaw portions, and wherein the first recess has a closed periphery and does not extend to and defines a hole on the free end of the at least one first jaw portion.

12. The tool as claimed in claim 11, wherein the gap defines an opening between free ends of the at least one first and at least one second jaw portions, wherein the second recess extends through the at least one second jaw portion in the opposing direction of the at least one first and at least one second jaw portions, and wherein the first recess has a closed periphery and does not extend to and defines a hole on the free end of the at least one second jaw portion.

13. The tool as claimed in claim 12, wherein the strengthening member has a first end mounted in the first recess and a second end mounted in the second recess.

14. The tool as claimed in claim 13, wherein joining portion has an outer periphery including a groove recessed thereinto, wherein the strengthening member engages the groove.

15. The tool as claimed in claim 1, wherein the first pivoting member has a first end and a second end and includes the first end thereof including a first connecting end and the second end thereof including the first driving end respectively, and wherein the at least one at least one first and the at least one second jaw portions extend in a direction away from the second driving end.

16. The tool as claimed in claim 15, wherein the second pivoting member has a first end and a second end and includes the first end thereof including a second connecting end and the second end thereof including the second driving end respectively, and wherein the at least one extension portion extends in a direction away from the second driving end.

17. The tool as claimed in claim 15, wherein the first driving end defines an engaging bar, and wherein the first driving end is polygonal in cross section.

18. The tool as claimed in claim 17, wherein the second driving end defines an engaging bar, and wherein the second driving end is polygonal in cross section.

* * * * *